US006763535B1

(12) United States Patent
Mann

(10) Patent No.: US 6,763,535 B1
(45) Date of Patent: Jul. 20, 2004

(54) UNITARY PILLOW DISPLAY

(76) Inventor: Charlene C. Mann, 3180 El Paso Dr., Columbus, OH (US) 43204

( * ) Notice: Subject to any disclaimer, the term of this patent is extended or adjusted under 35 U.S.C. 154(b) by 0 days.

(21) Appl. No.: 10/382,725

(22) Filed: Mar. 5, 2003

(51) Int. Cl.[7] ..... A47C 20/02

(52) U.S. Cl. ..... 5/491; 5/633; 5/907; 5/658; 5/308

(58) Field of Search ..... 5/491, 633–635, 5/658, 907, 53.1, 1, 308; D6/597, 601

(56) References Cited

U.S. PATENT DOCUMENTS

| | | | | |
|---|---|---|---|---|
| 395,043 A | | 12/1888 | Doremus | |
| 830,970 A | | 9/1906 | Cary | |
| 964,469 A | * | 7/1910 | Guth | 5/491 |
| 2,856,614 A | * | 10/1958 | O'Leary | 5/633 |
| 3,171,139 A | * | 3/1965 | Ziegenfuss | 5/53.1 |
| 3,327,330 A | | 6/1967 | McCullough | |
| 3,541,621 A | * | 11/1970 | Dauphin | 5/491 |
| 3,784,993 A | * | 1/1974 | Berkowitz | 5/308 |
| 3,849,810 A | | 11/1974 | Degan | |
| 3,968,529 A | | 7/1976 | Levin et al. | |
| 4,192,029 A | | 3/1980 | Bond | |
| 4,242,767 A | | 1/1981 | McMullen et al. | |
| 4,393,530 A | | 7/1983 | Stark | |
| 5,437,070 A | | 8/1995 | Rempp | |
| 5,864,904 A | | 2/1999 | Rudick | |
| 6,182,307 B1 | * | 2/2001 | Rutrick | 5/53.1 |
| 6,427,268 B1 | | 8/2002 | Davis | |

* cited by examiner

*Primary Examiner*—Michael F. Trettel
(74) *Attorney, Agent, or Firm*—David J. Dawsey; Michael J. Gallagher; Gallagher & Dawsey Co., LPA

(57) ABSTRACT

A unitary pillow display appearing as different pillows of varying sizes, shapes, and textures. The single unitary pillow display appears formed of a number of individual and non-joined pillows, and mimics the contemporary decorating technique of stacking a plurality of different pillows on a furniture surface. Variations in the material of the pillow sham heighten the illusion by providing the possibility of radical differences in coverings of varying parts of the display. The sham may enclose the unitary display in a highly permanent manner, or it may have an opening, with optional closure means, to allow it to slip over the display. The display may have sleeping pillow recesses in the body of the display. The display may be provided with a wide variety of optional accessories, such as pockets and means for hanging storage of the display.

24 Claims, 6 Drawing Sheets

UNITARY PILLOW DISPLAY

TECHNICAL FIELD

The present invention relates to the field of decorative pillows, in particular, to a unitary pillow display composed of multiple sub-units.

BACKGROUND

Contemporary home decorating often involves the use of multiple pillow displays on beds and other furniture articles. Generally, a selection of pillows of various shapes, sizes, and often with varied pillow covers or shams, are artfully arranged to produce a desired effect. By stacking pillows of different sizes and shapes in rows upon each other, three dimensional displays are created that display a pleasing variety of shapes and textures.

A shortcoming of the current art is that these displays must be painstakingly created and re-created over and over again when the bed or other furniture items are used. A typical display may be two or three pillows deep. To create the display, the pillows must, in the current state of the art, be stacked artfully upon each other in a side by side manner, whereby they are also generally overlapping. When the bed or furniture item is used, the pillows must be removed, one by one, and stored, and then the entire process must be repeated to re-create the display after use. Should anyone, particularly children or pets, sit on the pillow display, they are likely to disturb the arrangement of the individual pillows and destroy the aesthetic value of the display. The instant invention, due to its unitary nature, resists such disruption. Additionally, the instant invention has advantages in storage. The pillow display may be removed from the bed or furniture item as a unit without having to handle individual pillows, can be stored easily as a unit, and can be replaced as a unit. Significant time is saved in re-establishing the pillow display, and the pillows are not subject to scattering or loss.

Segmented pillows that lack this essential aesthetic preserving quality exist in the art. An example is U.S. Pat. No. 5,437,070 where a segmented pillow has a center section with radial cushioned extensions that creates surface cavities to promote pressure free areas for a user to sit or lie on, in contrast to the instant invention, which is designed to preserve an aesthetic effect and be a labor saving device in creating that aesthetic effect.

Pillows are also known to be joined by varying types of straps or other joining devices. This general class of pillows, which might be described as "tethered" pillows, can be constructed to allow for two pillows to be separated by a space designed to accommodate a body part, as seen in U.S. Pat. No. 5,864,904. A tethered pillow is also seen in U.S. Pat. No. 830,970, where rigid hinges attached to blocks fixed at the edge of two opposing sides of a pair of pillows serves to anchor the pillow shams together. Such a design in unsuitable for the rows of stacked pillows common in contemporary decorating, and introduce hard elements into an otherwise soft fabric design. Similarly incapable of stacking in other than a side by side manner, U.S. Pat. No. 3,968,529 teaches a series of pillow sections interconnected in a chain of hexagonal shapes. Similarly, U.S. Pat. No. 6,427,268 teaches a side by side segmented pillow that lacks the extensive three dimensional relief of the display of the instant invention.

Accordingly, the art has needed a means for improving pillow displays. Prior art devices have failed to recognize the importance of presenting a unitary display composed of multiple sub-sections to form a fixed, pleasing, display having the appearance of multiple individual elements. With these capabilities taken into consideration, the instant invention addresses many of the shortcomings of the prior art and offers significant benefits heretofore unavailable. Further, none of the above inventions and patents, taken either singly or in combination, is seen to describe the instant invention as claimed.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. In variable configurations, the unitary pillow display incorporates a visual trick upon the eye of a viewer. A single unitary pillow display appears to be formed of a number of individual and non-joined pillows, as the unitary display cleverly mimics the contemporary decorating technique of stacking a plurality of individual pillows on a furniture surface.

The unitary pillow display mimics the possible appearance of different pillows of varying sizes, shapes, and textures. Variations in the material of the sham enclosing the unitary display heighten the illusion by providing the possibility of radical differences in coverings of varying parts of the display. The sham may enclose the unitary display in a highly permanent manner, or it may have an opening to allow it to slip over the display. The display may have sleeping pillow recesses sculpted into the body of the display, so that sleeping pillow may be left in place on a bed while the display is in its functional position. A wide variety of textures and materials may form the display surface of the unitary display, and the display may be provided with a wide variety of optional accessories, such as pockets and means for hanging storage of the display.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

An object of the invention is to provide a unitary pillow display such that the display can be easily and quickly removed from its display location, which is an improvement over the technique of using a plurality of separate and unjoined pillows to create such a display, each of which must be removed and replaced individually into a display configuration. As one example, in use the unitary pillow display can be placed over the sleeping pillows and generally untidy upper end of a bed. To ready the bed for use, one can easily remove all of the apparent plurality of pillows in a single motion, since they are, in fact, a unitary display, and then conveniently store the unitary display until the user decides to restore the display to the bed.

A further object of the invention is to provide a unitary pillow display that will be, storable in a fixed configuration, and will not be subject to scattering and possible loss of the elements of the display.

Another object of the invention is to provide a unitary pillow display that mimics the appearance of separate pillows, yet will not be vulnerable to shifting disarrangement, as can easily happen with a plurality of separate pillows.

A further object of the invention is to provide a novelty pillow display, cleverly mimicking the appearance of a plurality of pillows, while in fact being of unitary construction.

BRIEF DESCRIPTION OF THE DRAWINGS

Without limiting the scope of the present invention as claimed below and referring now to the drawings and figures:

DESCRIPTION OF THE INVENTION

Figure 1:
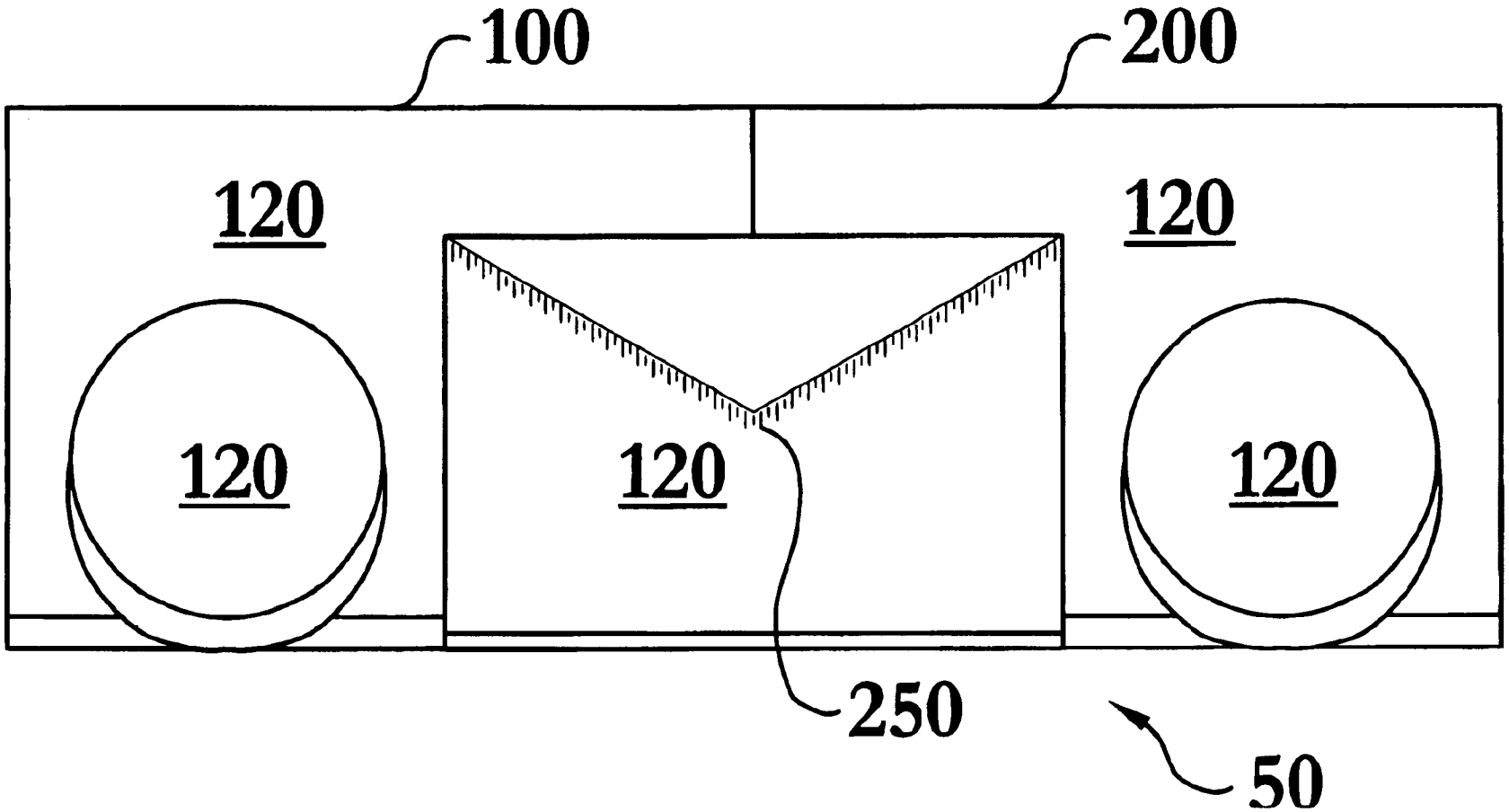
FIG. 1 shows a unitary pillow display in front elevation, in reduced scale.
Figure 2:
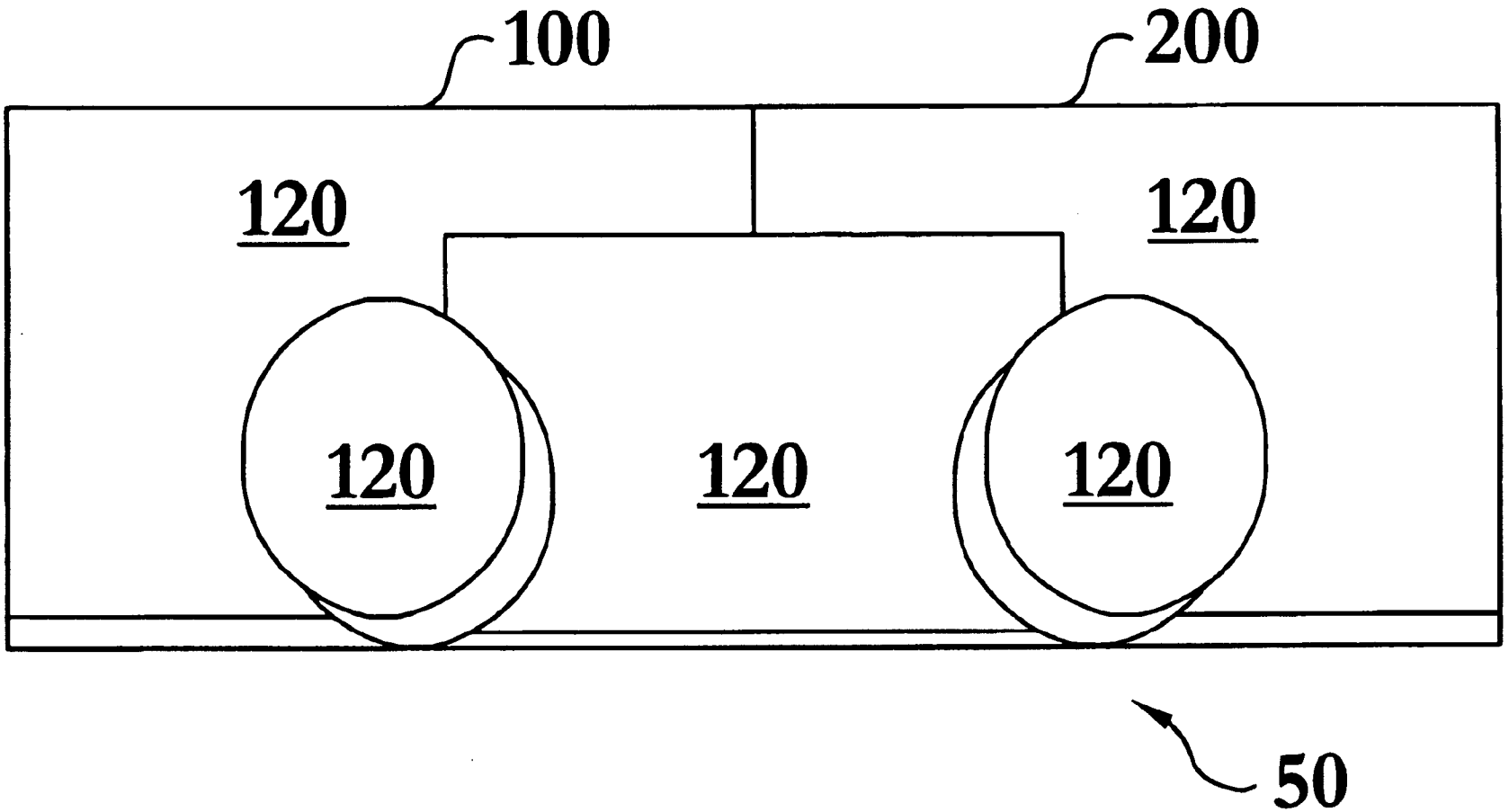
FIG. 2 shows a variation of the unitary pillow display of FIG. 1 in front elevation, in reduced scale.

The unitary pillow display of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With reference generally now to FIGS. 1 through 10, the instant invention comprises a unitary pillow display. In a simple embodiment, seen in FIGS. 1 and 2, a unitary pillow display 50 is designed for use on a furniture piece, such as, by way of example and not limitation, a bed. The unitary pillow display 50 comprises a unitary body 100 having at least one lower surface 110, seen in FIGS. 3, 4, and 5. Referring to FIGS. 1 through 6, the unitary pillow display 50 incorporates at least one display surface 120, at least one sidewall surface 130 having a width 132, seen in FIG. 5, and at least one rear surface 140. The unitary pillow display 50 is designed to resemble a plurality of individual pillows while at the same time obviating the numerous inconveniences posed by actually using a plurality of individual pillows. Various design elements contribute to the appearance of a plurality of individual pillows.

For example, the width 132 is not necessarily constant throughout the unitary display 50. Such variable in width 132 enhances the illusion that separate and unjoined pillows make up the display 50. Additionally, variability in coverings of the unitary display 50 also enhances this effect. For example, the unitary pillow display 50 is covered with at least one sham 200, seen in FIG. 1, having a plurality of distinct material portions. These distinct material portions are formed of varying materials, and are further formed to enclose the unitary body 100. The sham 200 and the corresponding distinct material portions, may be lined or unlined, and may be treated with a wide array of material treatments, such as those designed to be moisture or stain resistant. The use of varying materials helps foster the illusion that the viewer is seeing a plurality of separate pillows, as the eye of the viewer tends to take different sham 200 materials as evidence of separation of individual pillows. The more radical the differences in adjoining materials of different portions of the sham 200, the more likely the viewer will be fooled by the illusion. Such materials can include, by way of example and not limitation, variations in colors, surface textures, weights of materials, the presence or absence of ornamentation integral to the material, and various trims and attached accessories.

Figure 5:
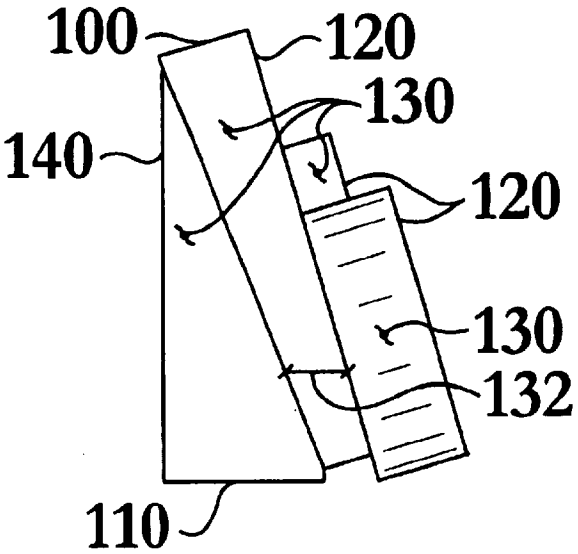
FIG. 5 shows a variation of the unitary pillow display of FIG. 1 in side elevation; in reduced scale.
Figure 4:
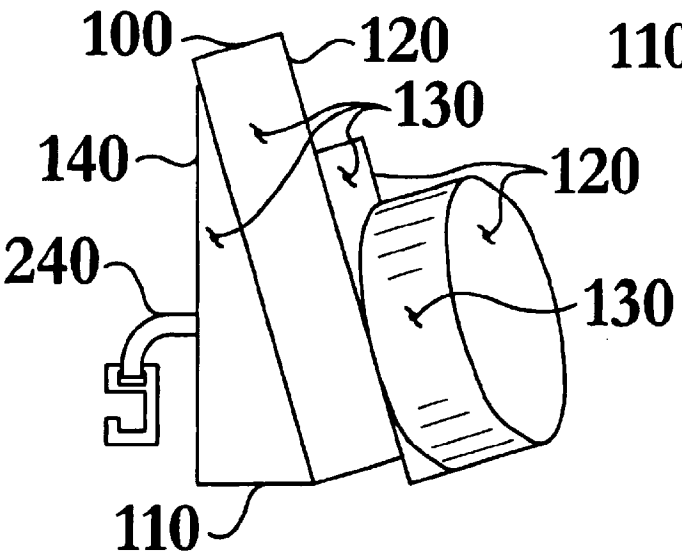
FIG. 4 shows the unitary pillow display of FIG. 2 in side elevation, in reduced scale.
Figure 3:
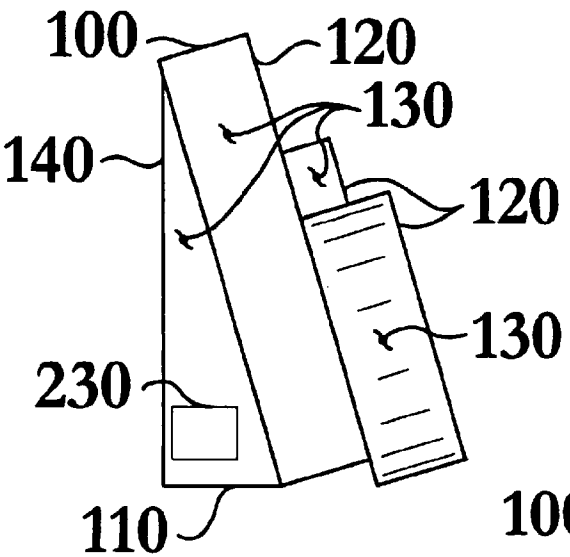
FIG. 3 shows the unitary pillow display of FIG. 1 in side elevation, in reduced scale.

As would be obvious to one skilled in the art, numerous varying embodiments are possible, some of which are seen in FIGS. 3 through 5. All or some of the plurality of individual pillows may be non-coplanar. Similarly, all or some of the plurality of individual pillows may appear substantially parallel, or the unitary body 100 may be formed to present the resemblance of a plurality of overlapping individual pillows. Having different portions of the unitary pillow display be non-coplanar or non-parallel can be utilized to further the illusion, as seen in the is subtle differences illustrated in the difference between FIGS. 3 and 4, that the display is composed of separate and unjoined pillows, as the viewer is unlikely to expect pillows to be joined in such a manner.

While the unitary body 100 may be molded or otherwise formed out of a single unit, it also may be assembled of various sub-units, such that the unitary body 100 is formed from a plurality of individual bodies joined together. Such possible sub-units may be joined together either before or after the application of the at least one sham 200. In those embodiments where the unitary display 50 is formed by joining separate sub-units, the sub-units themselves can be made of different materials from one another, to vary the resilience characteristics of the different sub-units, and to again further the illusion of separateness. Overall, as would be apparent to one skilled in the art, whether the unitary display 50 is formed initially of a single unit or is formed of separate sub-units that are later joined, the unitary display 50 maybe manufactured in different width and different overall sizes to complement standard or custom sized furniture, such as, by way of example and not limitation, single, queen, or king sized beds.

Figure 6:
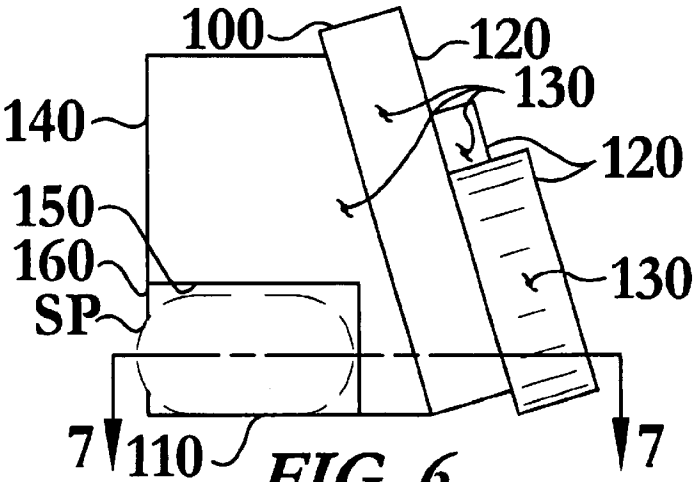
FIG. 6 shows a variation of the unitary pillow display of FIG. 1 in side elevation, in reduced scale.
Figure 7:
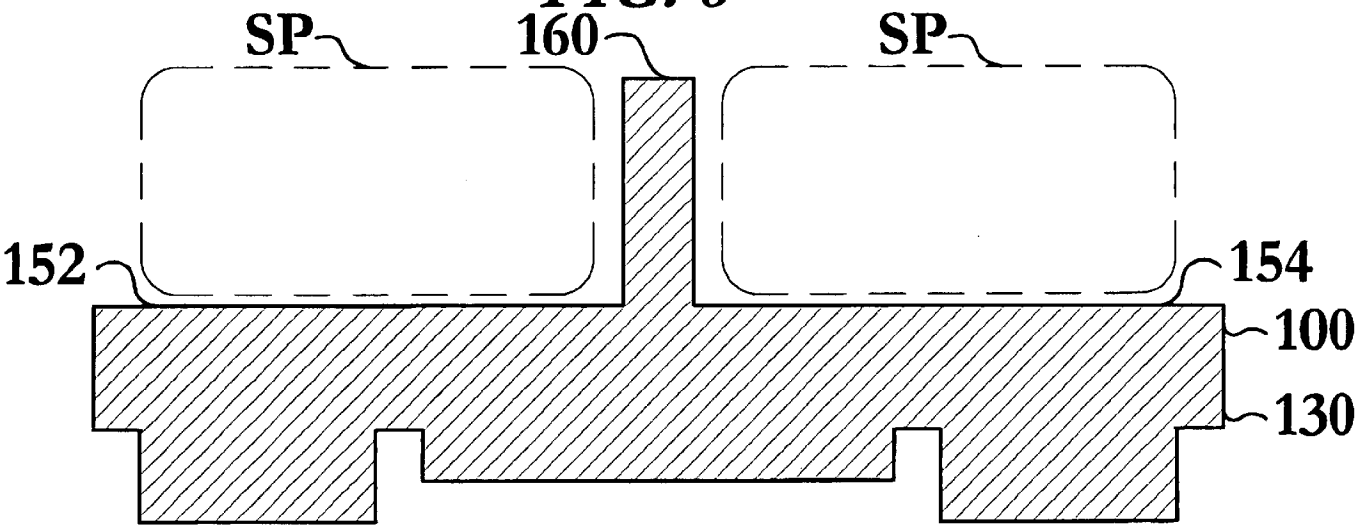
FIG. 7 shows a section view taken along line 7—7 of FIG. 6, in reduced scale.

To enhance the stability of the display when placed on a bed which has sleeping pillows in the traditional position near the head of the bed, the unitary body 100 may be formed with at least one sleeping pillow recess 150 to accommodate the sleeping pillows, seen in FIG. 6. Such an embodiment further increases the time saving efficiency of the unitary pillow display 50, as it 1o makes it possible to easily leave the sleeping pillows in the approximate position of use while the unitary pillow display 50 is displayed on top of them. In a variation of this embodiment, seen in FIG. 7, the unitary body 100 may be formed with a first sleeping pillow recess 152 and a second sleeping pillow recess 154, separated by a support member 160, such that two sleeping pillows will lie substantially under the display 50, in the separate first 152 and second 154 sleeping pillow recesses. In differently sized embodiments of the unitary display 50, the sleeping pillow recess 150, and, correspondingly, the first sleeping pillow recess 152 and second sleeping pillow recess 154 can be sized to accommodate various standard and custom sleeping pillow sizes, such as, by way of example and not limitation, regular and king size pillows.

Figure 8:
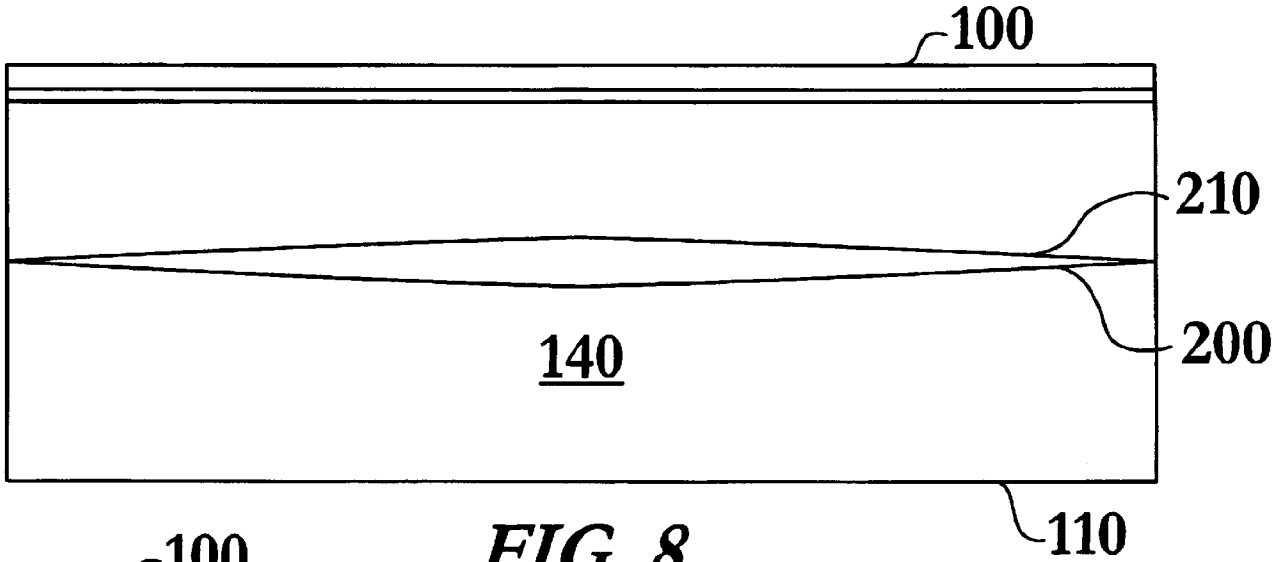
FIG. 8 shows the unitary pillow display of FIG. 1 in rear elevation, in reduced scale.
Figure 9:
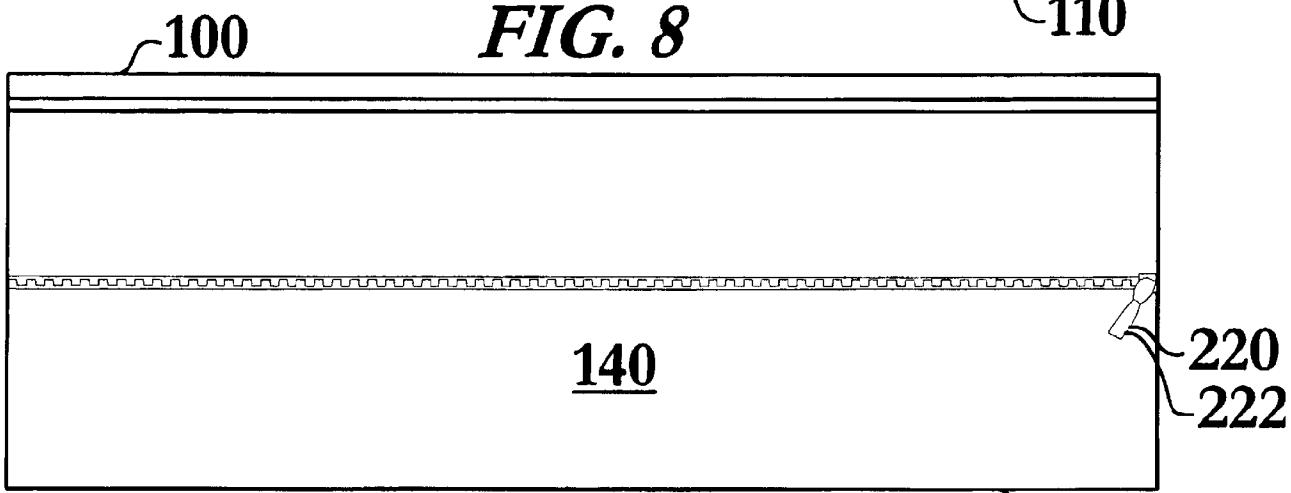
FIG. 9 shows a variation of the unitary pillow display of FIG. 1 in rear elevation, in reduced scale.

The at least one sham 200 may be sewn or otherwise fastened about the unitary body 100 in a highly permanent manner, or it may removably enclose the unitary body 100, as seen in FIGS. 8 and 9. A wide panoply of methods may be used to secure the at least one sham in a removable fashion about the unitary body 100, such as forming the at least one sham 200 to have an opening 210, seen in FIG. 8, and optionally to provide that opening 210 with a fastening means 220, seen in FIG. 9. The fastening means 220 may include buttons, flaps, hook and eye closures, snap closures, a zipper 222, or any other fastening means 220 that would be obvious to one skilled in the art.

The unitary pillow display 50 may be configured with a wide variety of options, such as, by way of example and not limitation, a pocket 230 attached to the at least one sham 200, seen in FIG. 3, to hold small articles, and at least one suspension device 240 attached to the at least one sham 200, seen in FIG. 4, to facilitate hanging storage of the unitary pillow display 50. The unitary pillow display 50, itself may feature a wide variety of decorative elements 250, such as trim, ribbons, bows, decorative stitching, indicia, such as illustrated in FIG. 1, or such other artistic elements as might be incorporated by a skilled and creative designer.

Figure 10:
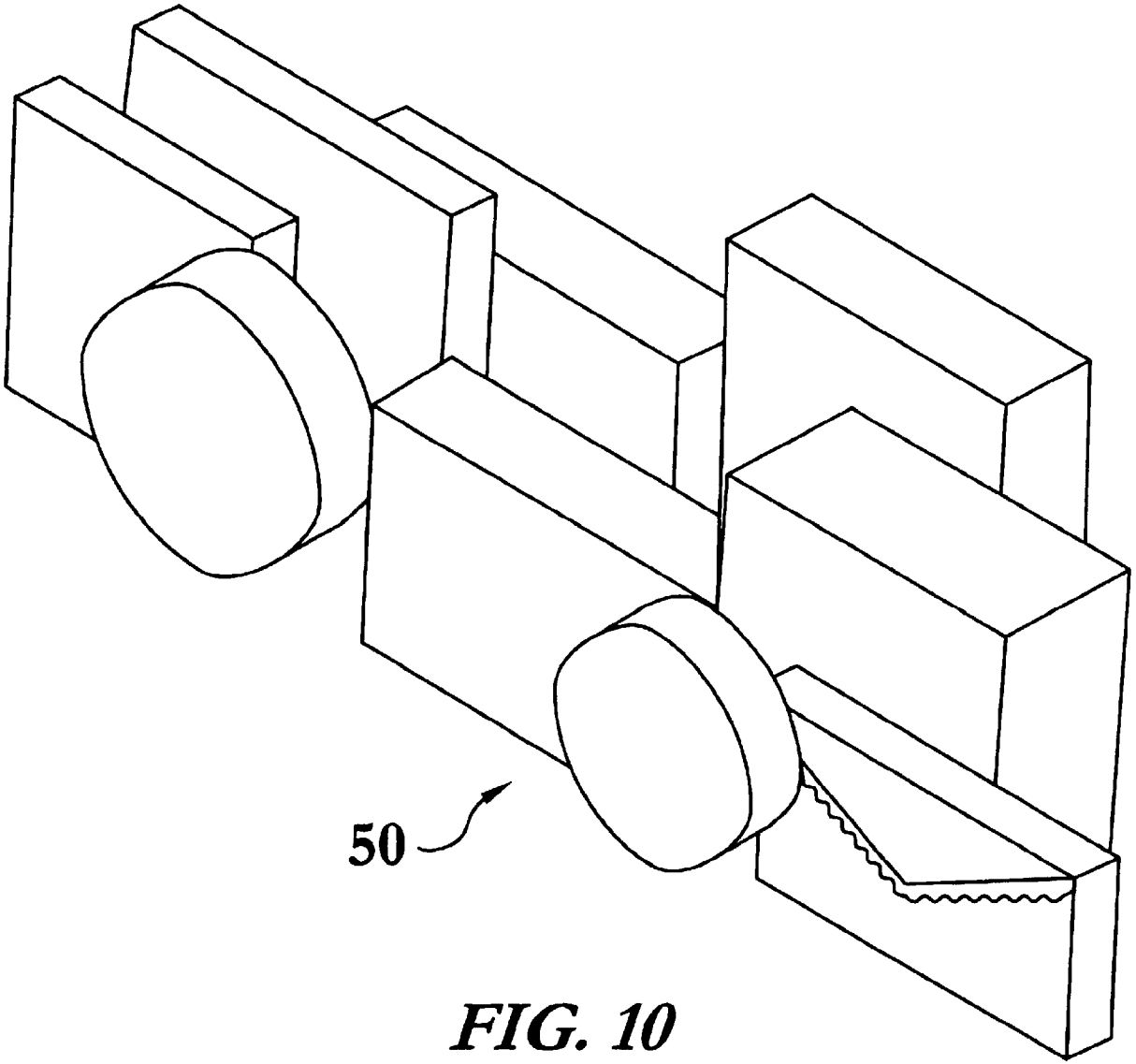
FIG. 10 shows a variation of the unitary pillow display in elevated front perspective view, in reduced scale.

An exemplary embodiment, seen in FIG. 10, illustrates, by way of example and not limitation, some of the wide variety of features possible in the instant invention. In FIG. 10, the effect of the unitary display 50 is enhanced by the appearance of different pillows of different thicknesses, shapes, and surface decorations. The overlapping of various sizes and shapes helps further the illusion that the unitary display 50 appears to be made of separate and unjoined pillows.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only a few variations of the present invention are describe herein, it is to be understood that the practice of such additional modification and variations and the equivalents thereof, are within the spirit and scope of the invention as defined in the following claims.

I claim:

1. A unitary pillow display for resting on a furniture piece, comprising:

a pliable unitary body having at least one lower surface for resting on the furniture piece, at least one display surface, at least one sidewall surface having a width, and at least one rear surface, whereby the unitary body is formed to resemble a plurality of non-coplanar individual pillows; and at least one sham, having a plurality of distinct material portions formed of varying materials to heighten the illusion of a plurality of non-coplanar individual pillows, and further formed to enclose the unitary body.

2. The display of claim 1, wherein a plurality of the plurality of individual pillows appear substantially parallel.

3. The display of claim 1, wherein the unitary body is formed to resemble a plurality of overlapping individual pillows.

4. The display of claim 1, wherein unitary body is formed from a plurality of individual bodies joined together.

5. The display of claim 1, wherein the width of the at least one sidewall is variable.

6. The display of claim 1, wherein the unitary body is formed with at least one sleeping pillow recess.

7. The display of claim 1, wherein the unitary body is formed with a first sleeping pillow recess and a second sleeping pillow recess, separated by a support member.

8. The display of claim 1, wherein the at least one sham removably encloses the unitary body.

9. The display of claim 8, wherein the at least one sham is formed to have an opening.

10. The display of claim 9, further including a fastening means.

11. The display of claim 10, wherein the fastening means is a zipper secured to the at least one sham and arranged to releasably close the opening.

12. The display of claim 1, further including at least one pocket attached to the at least one sham.

13. The display of claim 1, further including at least one suspension device attached to the at least one sham.

14. The display of claim 1, further including at least one decorative element on the at least one distinct material portion.

15. The display of claim 1, wherein the unitary body is formed to resemble a plurality of individual pillows of different shapes.

16. A unitary pillow display for resting on a furniture piece, comprising:

a pliable unitary body having at least one lower surface for resting on the furniture piece, at least one display surface, at least one sidewall surface having a variable width, and at least one rear surface, whereby the unitary body is formed to resemble a plurality of non-coplanar, overlapping, individual pillows of different shapes; and at least one sham, having a plurality of distinct material pons formed of varying materials to heighten the illusion of a plurality of non-coplanar individual pillows, and further formed to removably enclose the unitary body;

the plurality of distinct material portions having at least one decorative element; and the at least one sham further formed to enclose the unitary body, and having an opening including a fastening means.

17. The display of claim 16, wherein a plurality of the plurality of individual pillows appear substantially parallel.

18. The display of claim 16, wherein unitary body is formed from a plurality of individual bodies joined together.

19. The display of claim 16, wherein the unitary body is formed with at least one sleeping pillow recess.

20. The display of claim 16, wherein the unitary body is formed with a first sleeping pillow recess and a second sleeping pillow recess, separated by a support member.

21. The display of claim 16, wherein the fastening means is a zipper secured to the at least one sham and arranged to releasably close the opening.

22. The display of claim 16, fixer including at least one pocket attached to the at least one sham.

23. The display of claim 16, further including at least one suspension device attached to the at least one sham.

24. A unitary pillow display for testing on a furniture piece, comprising:

a unitary body having at least one lower surface for resting on the furniture piece, at least one display surface, at least one sidewall surface having a variable width, and at least one rear surface, whereby the unitary body is formed to resemble a plurality of non-coplanar, overlapping, individual pillows of different shapes, the unitary body formed from a plurality of individual bodies joined together;

wherein the unitary body is further formed with at least one sleeping pillow recess;

at least one sham, having a plurality of distinct material portions formed of varying materials, and further formed to removably enclose the unitary body;

the plurality of distinct material portions having at least one decorative element;

the at least one sham further formed to have an opening including a fastening means; and at least one suspension device attached to the at least one sham.

* * * * *